US005552569A

United States Patent [19]

Sapkowski

[11] Patent Number: 5,552,569

[45] Date of Patent: Sep. 3, 1996

[54] EXPONENTIAL MULTI-PORTED ACOUSTIC ENCLOSURE

[76] Inventor: Mechislao Sapkowski, 4a Calle de Los Palos Grandes, Qta. Raytel No. 2.11.41.03, Caracas, Venezuela, 1062

[21] Appl. No.: 400,606

[22] Filed: Mar. 8, 1995

[51] Int. Cl.[6] ..... A47B 81/06

[52] U.S. Cl. ..... 181/199; 181/151; 181/153

[58] Field of Search ..... 181/153, 156, 181/151, 184, 196, 199; 381/154, 155, 158, 159

[56] References Cited

U.S. PATENT DOCUMENTS

| | | | |
|---|---|---|---|
| 2,766,839 | 10/1956 | Baruch et al. | 181/199 |
| 2,885,024 | 5/1959 | Jordan | 181/199 |
| 3,393,766 | 7/1968 | Mitchell . | |
| 3,722,616 | 3/1973 | Beavers | 181/199 |
| 3,739,096 | 6/1973 | Iding | 381/155 |
| 3,945,461 | 3/1976 | Robinson . | |
| 4,223,760 | 9/1980 | LeTourneau . | |
| 4,421,957 | 12/1983 | Wallace, Jr. | 181/184 X |
| 4,580,654 | 4/1986 | Hale . | |
| 4,616,731 | 10/1986 | Robinson . | |
| 5,137,110 | 8/1992 | Bedard, Jr. et al. . | |

*Primary Examiner*—Khanh Dang
*Attorney, Agent, or Firm*—George W. Wasson

[57] ABSTRACT

An improved system for acoustic enclosures, which greatly enhances sound reproduction, with improved frequency response, reduction in harmonics-induced distortion, improved conversion of electrical to acoustical energy increased purity of sound due to better phase response among its other qualities. The acoustic principles utilized at those of the resonating air column, the horn-type form, and the multiport. A horn-shaped multiport comprised of a number of smaller ports is used to modify the resonating air column to produce the exponential multi-ported acoustic enclosure.

18 Claims, 2 Drawing Sheets

EXPONENTIAL MULTI-PORTED ACOUSTIC ENCLOSURE

This invention relates to an acoustic enclosure for electrodynamic speakers and more particularly to an enclosure having an arrangement of ports along a surface of the enclosure with the spacing, size and shape of the ports designed to improve the sound reproduction and frequency response, reduce the harmonic distortion, improve the conversion of electrical energy to acoustic energy, and increase the purity of sound due to better frequency response of the enclosure to the input energy.

BACKGROUND

Loudspeakers are the means for converting electrical energy of sound frequencies into acoustic energy that can be heard by humans. It is known that enclosing speakers in acoustic chambers can match better the electric energy to acoustic energy and enhance the reproduced acoustic energy by reducing the effects of distortions of the sound due to unwanted harmonics produced in the conversion of electrical energy into acoustic energy. It is also known that building the enclosure tot the speaker with selected dimensions can provide for the reproduction of wide frequency ranges in the reproduced acoustic energy. Such devices are known as acoustic enclosures. The form of the enclosure can be varied to produce desired effects in the resonating air volume as when the enclosure is formed as a horn with a throat at the input area and a mouth in the area where the acoustic energy exits. It is also known that positioning the speaker along the enclosure, rather than at an end in the case of column enclosures, accomplishes a desired reduction of harmonic distortion. Many forms of enclosures have been suggested in the prior art.

SUMMARY OF THE INVENTION

The present invention advances the concepts of speaker with the addition of multiple ports along at least one wall of the enclosure and with the arrangement, size and shape of the ports in a pattern that will enhance the reproduction of acoustic energy produced within and radiated from the enclosure. The enhancement of the reproduction is accomplished by extending the frequency range over which the reproduced acoustic energy will be substantially uniformly reproduced without harmonic distortion.

The extending of the frequency range or reproduction is accomplished by producing an enclosure with multiple ports along a wall of the enclosure with the ports arranged in a horn law shaped pattern thus making the enclosure less of a single frequency resonating air column and more of a broad-band frequency resonating column.

Reduction of the harmonic distortion in the reproduction of the acoustic energy in the enclosure of the present invention is accomplished by positioning the ports along a wall of the enclosure in a pattern of sizes, shapes and density designed to control the possible harmonic distortions.

An object of the present invention is an improved enclosure for an acoustic reproduction system in the form of an elongated, tubular enclosure with a plurality of ports along at least a wall of the enclosure arranged in a pattern that will enhance the reproduction of acoustic energy within the enclosure.

Another object of the present invention in accord with the preceeding object is an improved enclosure wherein the plurality of ports are arranged in a pattern that has a minimum number of ports or of area of ports near the source of the acoustic energy and an increasing number of ports or area of ports as the distance from the source increases.

Another object of the present invention in accord with the preceeding objects is an improved enclosure wherein the plurality of ports are arranged in a horn law shaped pattern with a low density of ports at a throat area near the source of the acoustic energy and a higher density of ports at a mouth area at a distance from the acoustic energy source (i.e. exponential opening).

Another object of the present invention in accord with the preceeding objects is an improved enclosure wherein the plurality of ports is an arrangement of ports of different sizes arranged in a pattern to effect a minimum of port area at a throat area near the source of acoustic energy and a higher accumulative port size area at a mouth area at a distance from the the acoustic energy source.

Further objects and features of the present invention will be readily apparent to those skilled in the art from the appended drawings and specification illustrating a preferred embodiment wherein:

DESCRIPTION OF PREFERRED EMBODIMENTS

Figure 1:
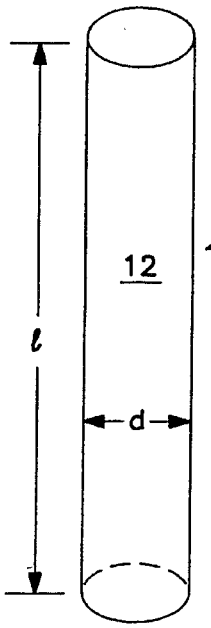
FIG. 1 PRIOR ART
FIG. 1 is an illustration of a prior art example of an acoustic resonating air column or tube normally used only in musical instruments pipe organs.
Figure 2:
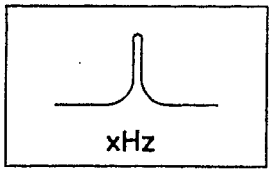
FIG. 2 PRIOR ART
FIG. 2 is a graph of energy vs frequency for the enclosure of FIG. 1.
Figure 3:
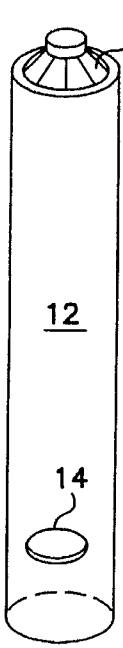
FIG. 3 PRIOR ART
FIG. 3 is an illustration of a prior art form of speaker enclosure with a single port.
Figure 5:
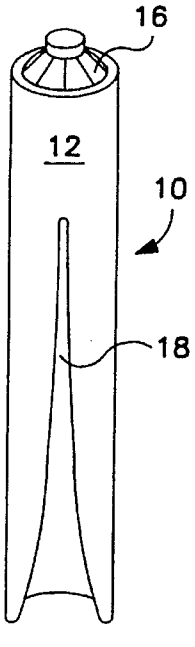
FIG. 5 PRIOR ART
FIG 5 is an illustration of a prior art form of speaker enclosure with an elongated slot.

FIG. 1 is an illustration of an enclosure 10 in the form of an elongated columnular structure 12 having a diameter "d" and a length "1". FIGS. 3 and 5 illustrate speaker enclosures 10 in a form that is known in the prior art. Such enclosures include an elongated columnular structure 12 having a design resonance frequency dependent upon the diameter "d" to a lesser extent and mostly the length "1" of the structure. A typical resonance frequency is illustrated in the graph of FIG. 2 for the simple column of FIG. 1 where the vertical dimension (ordinate) is amplitude of acoustic oscillation and the horizontal dimension (abscissa) is frequency. As seen in FIG. 2, the column has a resonance frequency at the center of the graph where the amplitude of oscillation peaks at some design frequency. The simple structure of FIG 1 has a variety of acoustic applications, for example organ pipes, flutes, or other musical instruments that use the operating principle of the resonance properties of columns of air. These columns basically resonate at a frequency which depends on the length "1" of the column. Harmonics of lesser intensity are also produced making this type of column useful in limited applications especially in musical instruments.

Figure 4:
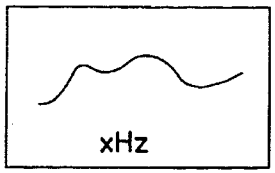
FIG. 4 PRIOR ART
FIG 4 is a graph of energy vs frequency for the speaker enclosure of FIG 3.

The prior art speaker enclosures have been modified to the form shown in FIG. 3 where a resonant column 10 is used with the combination of a port at 14 along the wall of the structure 12 and an input acoustic source or speaker 16 is added at one end. In this form the enclosure takes on some characteristics of a Helmholtz resonator. With the port modified in size, the resonance of the column can be varied and the frequency response of the structure can take the characteristic of amplitude vs frequency as illustrated in the graph of FIG. 4.

It should be noted that the classical Helmholtz type resonator as is currently applied to speaker technology, consists of an enclosure that does not have the form of a column, but rather the form of a polyhedron, and is commonly known as a "Bass Reflex" speaker. In these systems, dimensional parameters are made to match the resonance of the enclosed air volume with the resonance frequency of the speaker cone, to produce an "overcoupling" effect of both elements, so as to give a frequency response as shown in FIG. 4. This effect is well known in the electronics and acoustics fields. In all overcoupling of resonating elements, be they mechanical, acoustical or electrical, a depression is produced in the point of original resonance peak, and two less pronounced lateral peaks appear, resulting in a widening of frequency response.

Figure 6:
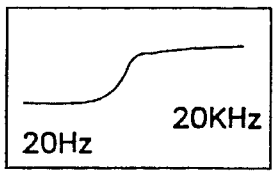
FIG. 6 PRIOR ART
FIG 6 is a graph of energy vs frequency for the speaker enclosure of FIG. 5.

In the prior art form of enclosure 10 as shown in FIG. 5, the tubular structure 12 is provided with the speaker 16 and a slot 18 which transforms the enclosure into what is known as a Horn-type structure which can be either exponential, hyperbolic, or conical. The exponential type of slot 18 is the more common. The design of an exponential horn column with slot is widely used in musical instruments and was used in the early gramaphones as well as in certain types of loudspeakers. This configuration has the advantage of not resonating within certain limits, and lends itself to perfect coupling between the speaker cone and the air within the column. However, in order to respond to all audible frequencies, horn dimensions need to be very large, rendering the system impractical for domestic applications, The frequency response of the structure of FIG. 5 is generally as shown in FIG. 6 which corresponds to a "high pass filter".

Figure 7:
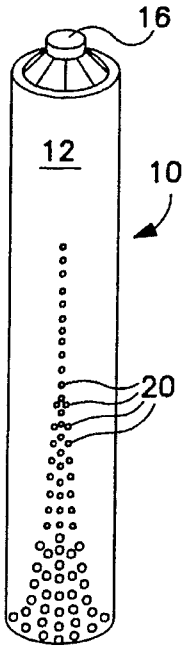
FIG. 7 is an illustration of a speaker enclosure in accord with the present invention.
Figure 8:
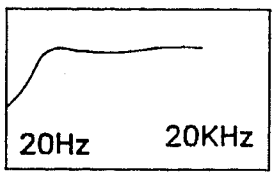
FIG. 8 is a graph of energy vs frequency for the speaker enclosures of FIGS. 7, 9, 10 and 11.

The speaker enclosure 10 of the present invention as illustrated in FIGS. 7, 9, 10, and 11 comprises an elongated enclosure structure 12 with a plurality of smaller ports 20 arranged in a horn law pattern to accomplish a wide frequency response. The frequency response of these arrangements of ports is shown in FIG. 8. The ports 20 are smaller than the port 14 illustrated in FIG. 3 and the smaller ports are of equal or different sizes and shapes and are arranged in a horn law shaped pattern or in pattern that works similarly to a horn shape because of its increasing exponential separation,and/or opening area.

The result of the arrangement and selection of port 20 sizes produces a combination of principles of a ported tubular enclosure, a horn type aperture and a distributed port pattern. The result of this arrangement and sizing of ports results in a) a wide frequency response due to the horn principle, b) acoustic damping due to the multiport, which also tends to dampen out transients and undesirable resonances, and renders unnecessary the use of large amounts of acoustic damping material as is currently seen in the available loudspeakers and enclosures, c) an enclosure tuned to a central frequency by means of controlling the total multi-port area to correspond to the loudspeaker cone resonance to achieve overcoupling, and further broaden the frequency response especially at low frequencies.

Figure 9:
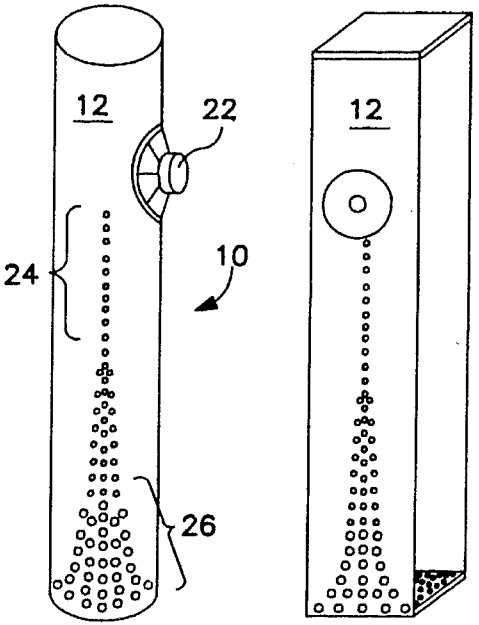
FIGS. 9, 10 and 11 are alternative forms of a speaker enclosure in accord with the present invention.
Figure 10:
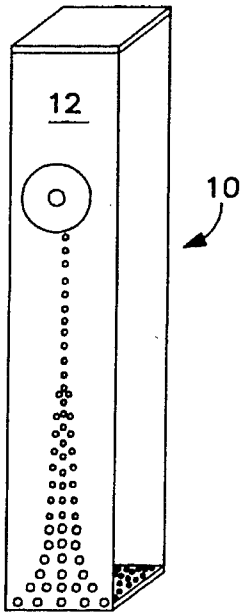
Figure 11:
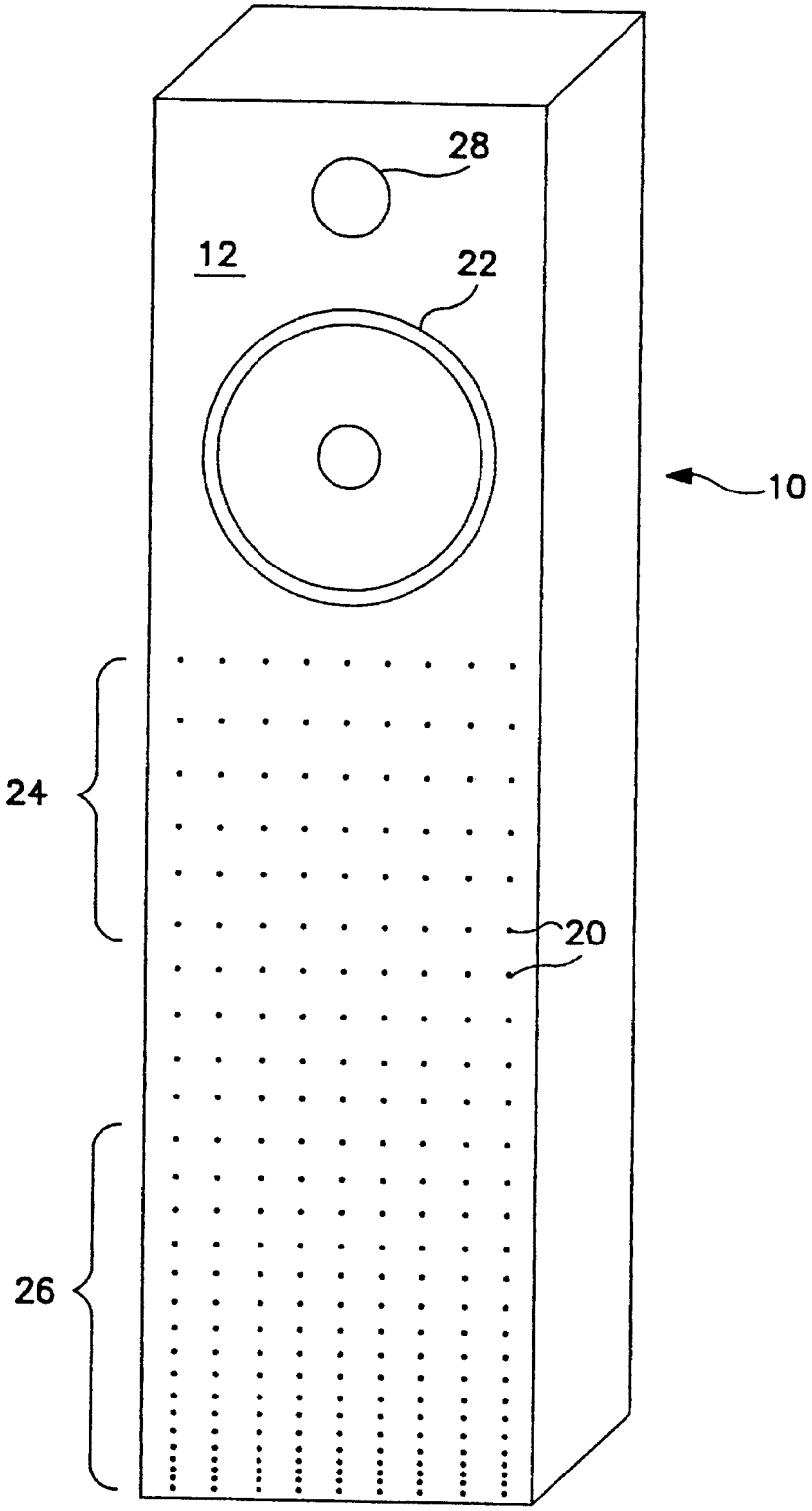

The arrangement of ports 20 in the sizes and pattern as shown in FIGS. 9, 10 and 11 also increases the acoustic efficiency of the loudspeaker by creating a totally new hybrid combination of loudspeaker and enclosure.

As illustrated in FIG. 9, the speaker 22 may be positioned along the enclosure 12 at a location to minimize the distortion caused by the third harmonic. In the position illustrated, the speaker 22 is positioned to strike the air column of the enclosure at approximately one third of the length (or height), where there is a node of the third harmonic, so that there is a reduction of any possible third harmonic distortion.

The total area of the distributed ports must be adequate so as to resonate with the air contained within the enclosure 10 at the same resonance frequency of the speaker 22, in order to achieve an overcoupling as is usual in Helmholtz (Bass Reflex) resonators.

However, in this case the overcoupling is further modified by the acoustic resistance properties of the distributed ports, which dampens transients, and additionally by the properties of the horn form (i.e. exponential opening) which, being nonresonant over a wide are frequency range, serves to broaden the frequency response of the whole device.

A practical method for obtaining the required distributed port size and form is by experimentally drilling ports until the bandpass center at the speaker's normal frequency resonance is obtained. This could also be obtained by mathematical calculations of specially-designed programs.

The spacing and pattern of the ports in the form of a horn produces a desired broadening of the response of the enclosure. The spacing of the ports can be accomplished by providing a low density of ports at the throat area 24 and a higher density of ports at the mouth area 26. The throat and mouth area spacing of ports 20 can be arranged in the horn-shaped pattern as shown in FIGS. 7, 9 and 10 or the spacing can be arranged by the exponential law, horn type as shown in FIG. 11 where a throat area 24 is accomplished by a reduced density of ports 20 and a mouth area 26 is accomplished by an increased density of ports 20. A similar density of port area can be accomplished by variations in the size of the ports 20 by using small ports at the throat area and larger ports at the mouth area.

FIGS. 7 and 9 illustrate cylindrical enclosures 10 with a pattern of ports 20 along the wall of the elongated columnular structure. FIGS. 10 and 11 illustrate rectangular or square cross-sectional enclosures with FIG. 10 illustrating a pattern of ports 20 in a horn shape along one wall of the enclosure and FIG. 11 illustrating a pattern of ports 20 for producing a density of ports that represents a horn-shaped density. The elongated columnular structure of the present invention can be circular, triangular, quadrangular, hexagonal or elliptical in cross-section without effecting the basic concept of the invention and any spurious resonances can be compensated for by slight variations in the enclosure itself and the shape of the ports 20 arranged in the horn-type multiport form as shown.

As illustrated in FIG. 11, auxiliary speakers designed for specific frequency ranges can be provided along the enclosure. In the form illustrated, a tweeter speaker 28 is shown above the input speaker 22. Tweeters are designed for higher frequencies and are substantially directional so they are not placed to develop an air column resonance within the enclosure; they are usually placed at a position where their reproduced sounds will be directed toward the listening area around the enclosure.

The use of the distributed sizes and pattern of ports as illustrated in FIGS. 7, 9, 10 and 11 results in an enclosure having a smooth, wide frequency response with minimized undesirable transients, and more efficient conversion of electrical energy to acoustic energy through the use of minimal amounts of absorbant materials within the enclosure. Distortion due to spurious harmonic resonances are damped out by both the acoustic resistance of the divided port and also by the horn configuration.

As disclosed in the preceding paragraphs, the present invention is an enclosure for a loudspeaker wherein the enclosure is an elongated columnular structure having walls extending between ends of the structure, the enclosure may be terminated at one end by the mouth of the horn structure, a speaker or other means for introducing acoustic energy is positioned along the enclosure near one end, a series of cutout portions defining ports are positioned along at least one wall of the enclosure in a multi-port pattern that may be horn-shaped or may be in a density of ports that produces the effect of a horn-shaped port pattern. The enclosure may have many differing cross-sections including circular, rectangular or multisided structures. The sizes, shapes and pattern of the ports may be all the same, of different sizes or a mixture of those sizes and the pattern of ports may simulate a horn-shaped pattern, and the distribution of ports and their sizes may be random to break or eliminate spurious resonances along the enclosure. Also, the ports may be square, rectangular, ovaloid, or long ports with wavy or straight edges and may be arranged in groupings designed to control spurious resonances along the enclosure.

The arrangement of ports along the enclosure contemplates the positioning of a limited number of ports in a throat area of a horn-shaped pattern with the number or density of ports increasing along the horn-shape to a mouth area. The effect of a horn-shaped pattern may be accomplished by controlling the shape, size and density of ports between the throat area and the mouth area. The throat area of the horn-shape is preferably at or near the position of the input speaker and the mouth area is spaced from the speaker or near an end of the enclosure. The pattern or density of ports will follow the expansion law of the horn principle.

While certain preferred embodiments of the present invention have been specifically disclosed, it should be understood that the invention is not limited thereto as many variations will be readily apparent to those skilled in the art and the invention is to be given the broadest possible interpertation within the terms of the following claims.

I claim:

1. An acoustic enclosure for a loudspeaker for producing a broadened acoustic response comprising an elongated enclosure in the form of a tubular column with an elongated axial dimension and a hollow interior including ends and a wall extending between said ends, means adjacent to one end of said tubular enclosure for permitting the introduction of acoustic energy into said enclosure, said acoustic enclosure being terminated adjacent to the other end in a distributed port, said distributed port comprising:

a) a horn type distribution of cutout portions defining individual ports along a wall of said enclosure, b) said horn type distribution of cutout portions comprising a plurality of individual openings along said wall of said tubular enclosure, c) and said individual openings being arranged in a horn-shaped pattern of sized and spaced ports along said tubular enclosure to define collectively a horn type distributed port in said acoustic enclosure.

2. The acoustic enclosure on claim 1 wherein said cutout portions defining said individual ports are a) spaced along the axial dimension of said wall of said tubular enclosure and b) arranged in a pattern of sized and spaced openings increasing in density of ports axially along said wall.

3. The acoustic enclosure of claim 2 wherein said cutout portions defining said ports are of different sizes, said ports increasing in dimensional size in relation to their axial distance from said one end of said enclosure along said wall.

4. The acoustic enclosure of claim 2 wherein said spacing, size and pattern of said openings establishes a set of openings arranged in said horn-shaped distribution of ports along said wall.

5. The acoustic enclosure of claim 1 wherein said means for permitting the introduction of acoustic energy into said enclosure is located an axial distance from one end along said wall to reduce the third harmonic resonance of acoustic energy introduced into said enclosure.

6. The acoustic enclosure of claim 5 wherein said distance along said wall is about one third of the axial dimension of said enclosure.

7. The acoustic enclosure of claim 1 wherein said one end of said enclosure is closed with acoustic energy absorbant material.

8. The acoustic enclosure of claim 4 wherein said horn-shaped distribution of said openings is a pattern of exponential density of openings along said axial distance of said wall.

9. The acoustic enclosure of claim 4 wherein said horn shaped distribution of said openings is a pattern of hyperbolic density of openings along said axial distance of said wall.

10. The acoustic enclosure of claim 4 wherein said distribution of said ports begins with ports of a first size and increases to ports larger than said first size along said axial distance.

11. The acoustic enclosure of claim 4 wherein said distribution of said ports begins with a single small port and increases to groups of smaller and larger ports to increase said port density along said axial dimension.

12. The acoustic enclosure of claim 8 wherein said distribution of said ports begins with a low port density near said means for introducing acoustic energy and increases in port density as the axial distance increases from said means for introducing acoustical energy.

13. The acoustic enclosure of claim 8 wherein said openings are all the same size, said ports being aligned in rows of spaced ports along said wall, the spacing between said ports decreases in axial distance as said axial distance along said wall increases, whereby the density of ports increases exponentially as said axial distance from said means for introducing acoustic energy increases.

14. The acoustic enclosure of claim 1 wherein said means for introducing acoustic energy is a loudspeaker driven with acoustic frequency energy.

15. The enclosure of claim 14 wherein said means for introducing includes the addition of a mid to high acoustic frequency range loudspeaker.

16. The acoustic enclosure of claim 1 wherein said elongated enclosure is circular in cross-section and tubular in axial direction.

17. The acoustic enclosure of claim 1 wherein said elongated enclosure is rectangular in cross-section and tubular in axial direction.

18. The acoustic enclosure of claim 1 wherein said elongated enclosure is polygonal in cross-section and tubular in axial direction.

* * * * *